US005881940A

United States Patent [19]

Almeras et al.

[11] Patent Number: 5,881,940

[45] Date of Patent: Mar. 16, 1999

[54] APPARATUS FOR SEALING FIXING PLUGS

[75] Inventors: Roland Almeras, Tournon; Patrick Herelier, Saint Jean de Muzols; Frédéric Nayrac, Valence, all of France

[73] Assignee: Societe de Prospection et D'Inventions Techniques (SPIT), Bourg-Les-Valence, France

[21] Appl. No.: 766,256

[22] Filed: Dec. 13, 1996

[30] Foreign Application Priority Data

Dec. 13, 1995 [FR] France ..... 95 14763

[51] Int. Cl.[6] ..... B25C 1/12

[52] U.S. Cl. ..... 227/10

[58] Field of Search ..... 227/10, 9, 11, 227/130; 123/23, 24 A, 46 H

[56] References Cited

U.S. PATENT DOCUMENTS

| | | | |
|---|---|---|---|
| 4,349,141 | 9/1982 | Ollivier et al. | 227/10 |
| 4,358,041 | 11/1982 | Ollivier | 227/10 |
| 4,533,077 | 8/1985 | Jochum . | |
| 4,585,077 | 4/1986 | Bergler | 173/13 |
| 4,651,912 | 3/1987 | Hawkins | 227/9 |
| 4,941,391 | 7/1990 | Ehmig et al. . | |
| 5,269,450 | 12/1993 | Popovich et al. | 227/10 |
| 5,538,172 | 7/1996 | Jochum et al. | 227/10 |

FOREIGN PATENT DOCUMENTS

| | | |
|---|---|---|
| 0 346 275 | 5/1989 | European Pat. Off. . |
| 1478814 | 12/1962 | Germany . |
| 43 13 504 | 10/1994 | Germany . |
| 943640 | 12/1963 | United Kingdom . |

*Primary Examiner*—Scott A. Smith
*Assistant Examiner*—John Paradiso
*Attorney, Agent, or Firm*—Schwartz & Weinrieb

[57] ABSTRACT

The apparatus comprises a plunger (13) designed to slide in a front portion (11) of the apparatus acting as a plug guide, for driving a plug and sealing it, then to be returned rearwardly to the firing position, with balls (18) for braking the plunger (13) which are mounted in recesses of the plug guide (11). By cooperation with the plunger (13), the balls (18) are driven radially towards the plunger (13) upon application of the apparatus and rearward sliding of the plug guide (11).

20 Claims, 4 Drawing Sheets

APPARATUS FOR SEALING FIXING PLUGS

FIELD OF THE INVENTION

The present invention concerns an apparatus for sealing fixing plugs, with a plunger designed to be propelled forwardly in a barrel and to slidably move through a front portion of the apparatus acting as a plug guide, for driving a plug and sealing it, and then being returned rearwardly to the firing position, and with braking means which are arranged so as to brake the plunger only when it slides in one direction and including at least one braking ball mounted in a recess of the plug guide and arranged so as to be driven radially towards the plunger, by co-operation with the plunger, in its sliding movement in the one direction.

BACKGROUND OF THE INVENTION

Apparatus similar to the apparatus of the present invention is described in EP-A-0 346 275. In this apparatus, each braking ball is mounted in a recess of an axial extension of the plug guide which is larger than its diameter and a fixed wedge drives the ball towards the plunger when the latter, propelled forwardly, entrains it forwardly in its recess.

This arrangement was aimed at reducing the drawback of a plunger retaining ball mounted in a recess of an axial extension substantially equal to its diameter and subject to the permanent radial action of a spring, even during rearward and therefore more difficult return of the plunger, as taught by DE-C-1 058 950.

OBJECT OF THE INVENTION

The invention of the present application does not in turn aim to improve the apparatus of EP-A-0 346 275, but to propose the use of the device with a braking ball as a generally so-called plunger return device, instead of the usual pawl.

SUMMARY OF THE INVENTION

For this purpose the invention concerns a sealing apparatus of the type mentioned above, characterized in that the braking means are arranged to drive the ball radially towards the plunger upon application of the apparatus and rearward sliding of the plug guide.

Thus on application of the apparatus, the plug guide and the plunger are rigidly slidably connected, and rearward sliding of the plug guide therefore drives the plunger rearwardly into the firing position.

Preferably the braking means are arranged so as to rigidly slidably connect the plug guide and plunger under the action of an apparatus opening spring.

Advantageously the braking means are arranged to rigidly slidably connect the plug guide and plunger before complete opening of the apparatus and to disconnect them at the end of the application of the apparatus.

In an interesting embodiment of the apparatus of the invention, the braking means include the opening spring, abutting against a shoulder of the barrel and against a guide ring rigidly slidably connected to the plug guide and mounted so as to slide in a groove of the barrel, and a braking ring arranged to abut against the front end of the groove of the barrel and rigidly connect the plug guide and plunger during final forward sliding of the plug guide.

Advantageously the guide ring is screwed onto the plug guide and the braking ring comprises a rear portion with a wider internal cross-section preventing any co-operation with the braking ball.

In another embodiment of the apparatus of the invention, the braking means include a ring rotatably mounted on the plug guide, with a recess for reception of the ball, and the plunger comprises a rod portion of narrower cross-section.

BRIEF DESCRIPTION OF THE DRAWINGS

The invention will be understood better with the aid of the description below of several embodiments of the apparatus of the invention, with reference to the attached drawings in which like reference characters designate like or corresponding parts throughout the several views, and wherein.

DETAILED DESCRIPTION OF THE ILLUSTRATED EMBODIMENTS

Figure 1:
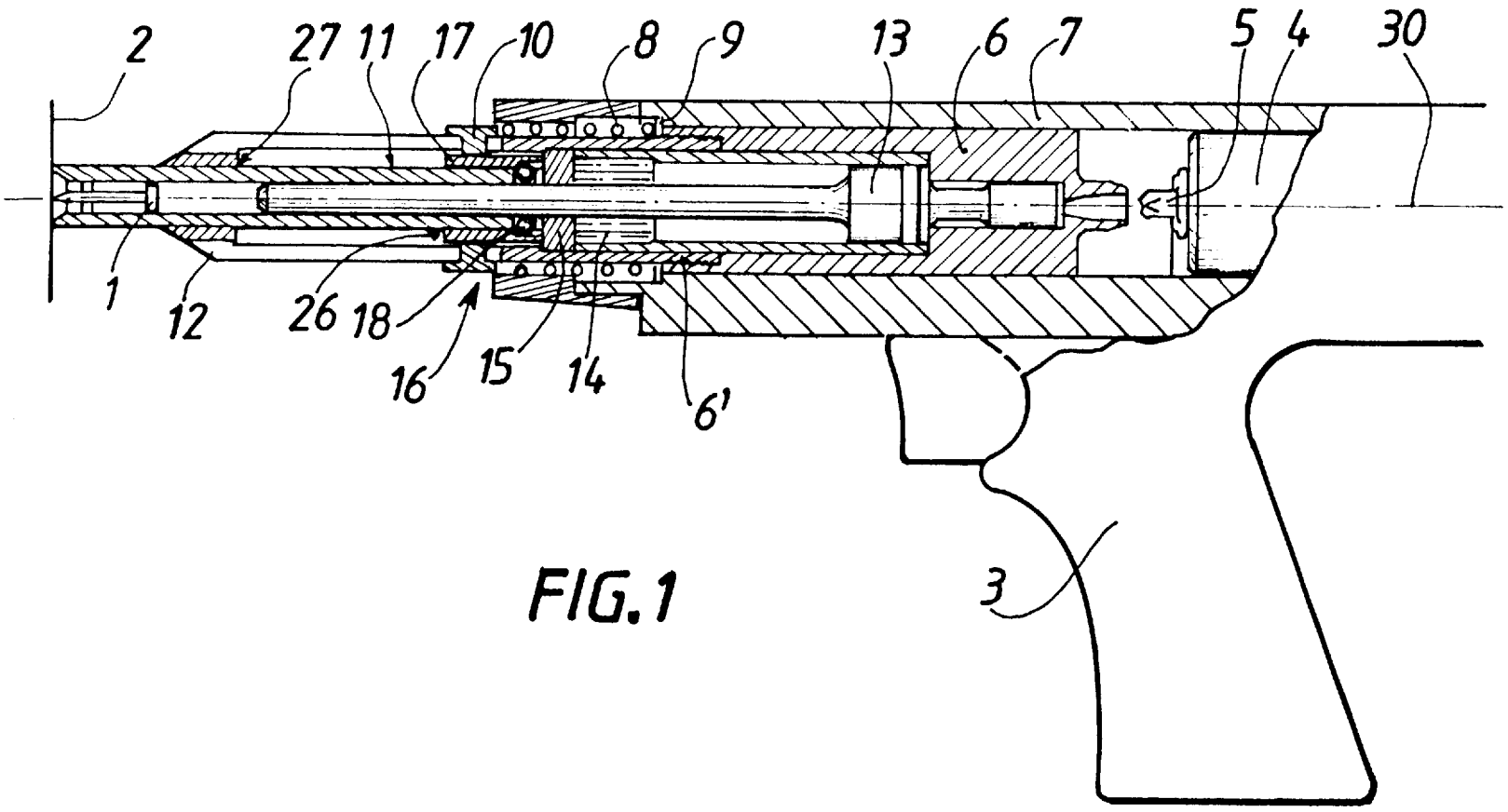
FIG. 1 is a view in partial axial section of a first embodiment of the apparatus, almost at the end of the application of the apparatus and, prior to firing.
Figure 2:
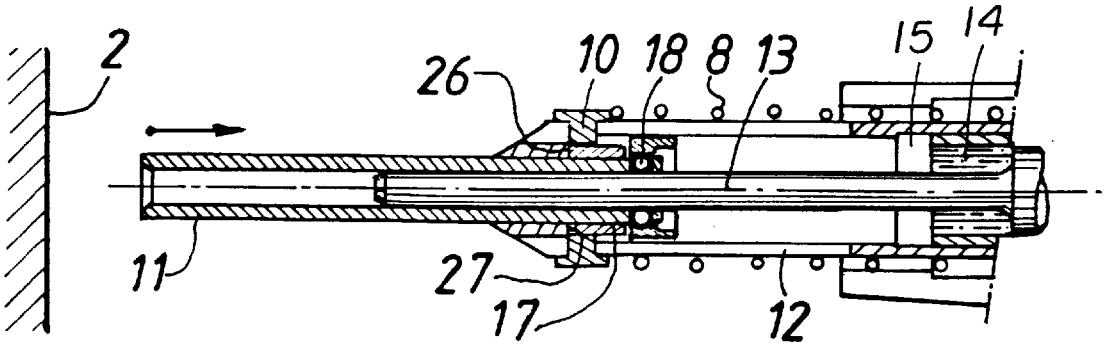
FIG. 2 is a view in axial section, in the open position, of the apparatus of FIG. 1.
Figure 3:
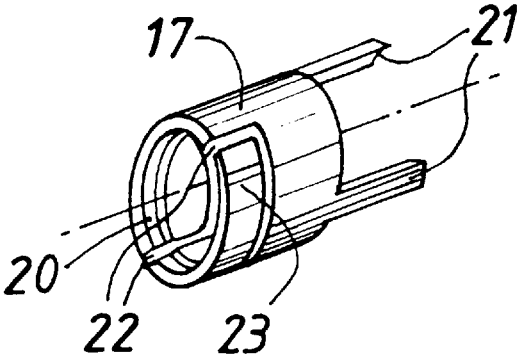
FIG. 3 is a perspective view of the locking ring of the apparatus of FIG. 1.

The apparatus which will now be described is designed to seal a plug 1 in a substrate material 2. The apparatus comprises a handle 3, in which are integrated a firing system with a breech 4, and a system for the supply of cartridges 5. A barrel 6, having an axis 30, is slidably mounted in a barrel holder 7 rigidly connected to the handle 3, with a stroke allowing passage of the cartridge 5 before firing. This stroke of the barrel 6 is obtained against the action of an opening spring 8, abutting against a washer 9, itself abutting against a shoulder of the barrel holder 7 on the one hand, and against a guide ring 10 rigidly connected to a plug guide 11, on the other hand. The rear portion of the barrel 6 is extended forwardly by a portion 6' which is screwed into the rear portion and in which is formed at least one longitudinal groove 12 in which the guide ring 10 is slidably mounted.

A plunger 13 is mounted in the barrel 6, 6' so as to be propelled forwardly under the action of the energy of a cartridge 5, an to slide in the plug guide 11 and drive the plug 1 placed in the plug guide 11. In its forward movement, at the end of the stroke, the plunger 13 is braked by a damping ring 14 against which its head abuts, the ring 14 itself abutting against a centering ring 15.

The apparatus comprises a device 16 for returning the plunger 13 to the firing position including, apart from the plug guide 11, the guide ring 10, the spring 8 and the front barrel portion 6', with its groove 12, a braking ring 17, and a pair of braking balls 18.

Figure 4:
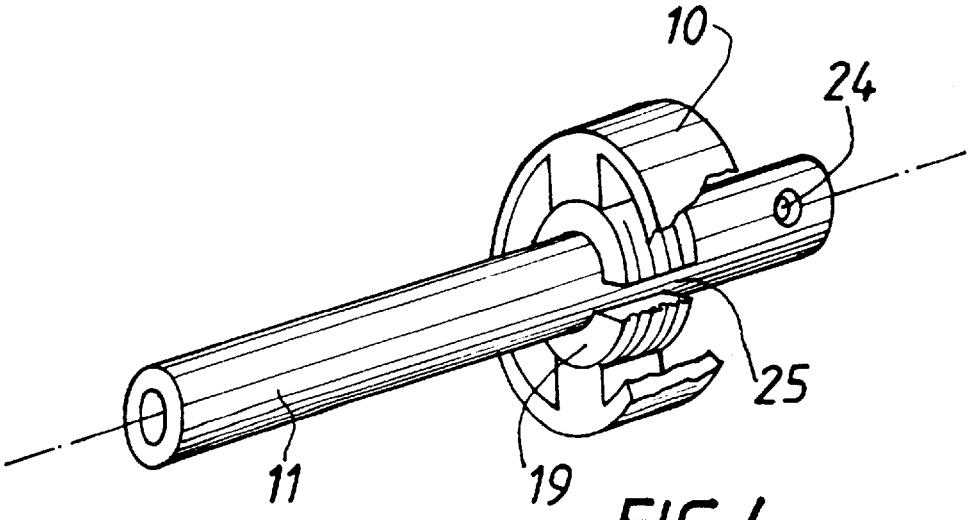
FIG. 4 is a perspective view of the plug guide, with its guide ring, of the apparatus of FIG. 1.

The guide ring 10 is screwed onto an annular projection 19 of the plug guide 11 (FIG. 4).

The braking ring 17, slidably mounted on the plug guide 11, comprises a rear portion 20 with a wider internal cross-section than that of the front portion substantially corresponding to that of the outer wall of the plug guide 11, and it is extended forwardly by two lateral support arms 21 extending through apertures 25 formed in the annular projection 19. Cut-outs 22 formed in the wider portion 20 form radially elastically deformable tabs 23.

At the rear of the plug guide 11 are formed, two diametrically opposite, recesses 24 in which are accommodated the braking balls 18. The balls 18 have a diameter substantially equal to that of their receiving recesses 24 but larger than the thickness of the plug guide in which they are formed.

When the apparatus is applied to the material 2, the plug guide 11 is moved rearwardly and, at the end of the application, it comes into contact with the centering ring 15 against the action of the spring 8 by means of the guide ring 10.

Due to abutment of the plug guide 11 against the centering ring 15, the braking ring 17 has been moved relatively forwardly so that the portion with the wider cross-section 20 is disposed opposite the balls 18, which are not driven by the ring 17 towards the plunger 13. Thus, no force being exerted on the balls 18, no resistance is applied to the rod of the plunger 13 after firing. The balls 18 not being in contact with the braking ring 17, they can roll freely on the plunger rod.

After firing, and when the apparatus is removed from the supporting surface, under the action of the spring 8, the barrel 6, 6' is driven forwardly and the cartridge 5 is released. Still under the action of the spring 8, the guide ring 10 is driven forwardly, entraining with it the plug guide 11. In this movement, the balls 18 roll over the plunger 13 without effort and drive the braking ring 17, by the zone connecting its two portions with different cross-sections, until the front end 26 of the ring 17 abuts against the front end 27 of the groove 12. Then, in relation to the plug guide 11, the braking ring 17 slides rearwardly and its front portion with the "narrower" cross-section comes into contact with the balls 18, and drives them radially towards the plunger 13 to exert pressure on the plunger 13 and thus rigidly connect the plug guide 11 and this plunger 13.

After introduction of a new plug 1 into the plug guide 11, when the apparatus is again applied against substrate 2, against the action of the spring 8 the plug guide 11 by the ring 17 and the braking balls 18 drives the plunger 13 into the firing position before the centering ring 15 drives the braking ring 17 relatively forwardly and thus releases the balls 18 so as to disconnect the plunger 13 from the plug guide 11.

Figure 5:
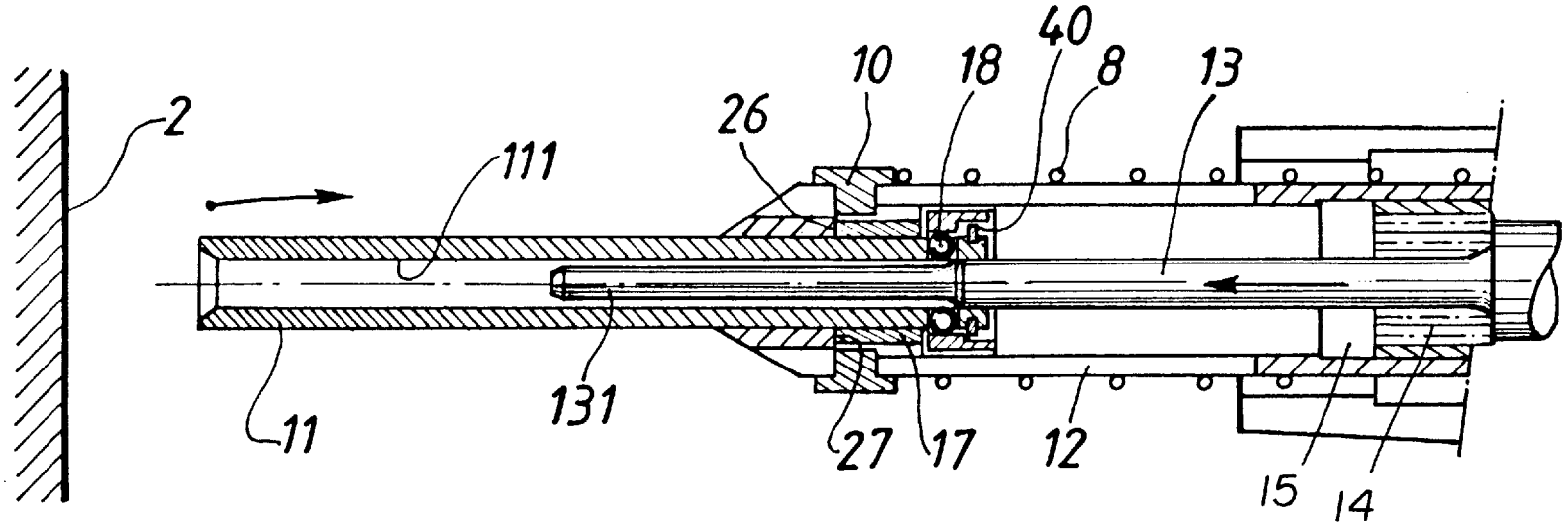
FIG. 5 is a view in partial axial section of a second embodiment of the apparatus in the open position.

In the embodiment of FIG. 5 of the plug guide 11, the latter carries, at the rear of the recesses 24 for receiving the braking balls 18, a retaining ring 40 which fulfills two functions. The first one is to prevent, by a stop effect, the braking ring 17 from being disconnected from the plug guide 11. The second function is to ensure a positive connection between the plunger 13 and the ring 17 while still acting as a stop for the braking ring 17 which is driven rearwardly under the action of the braking balls 18 subjected to the force of the plunger 13 which, on application of the apparatus, has a tendency to drive them in rotation.

Still with reference to the embodiment of FIG. 5, a portion 131 of the rod of the plunger 13 has a section with a diameter smaller than that of the bore 111 of the plug guide 11. Owing to this, the braking balls 18 can more easily project in the bore 111 without having to overcome the resistance of the plunger rod 131. Moreover, at the moment of application, the reaction of the balls 18 to contact of the plunger rod 131 is more effective.

The apparatus described herein before with reference to FIG. 4 comprises a guide ring 10 screwed onto the plug guide 11. Naturally, the guide 11 and its guide ring 10 could also be made in one piece.

Figure 6:
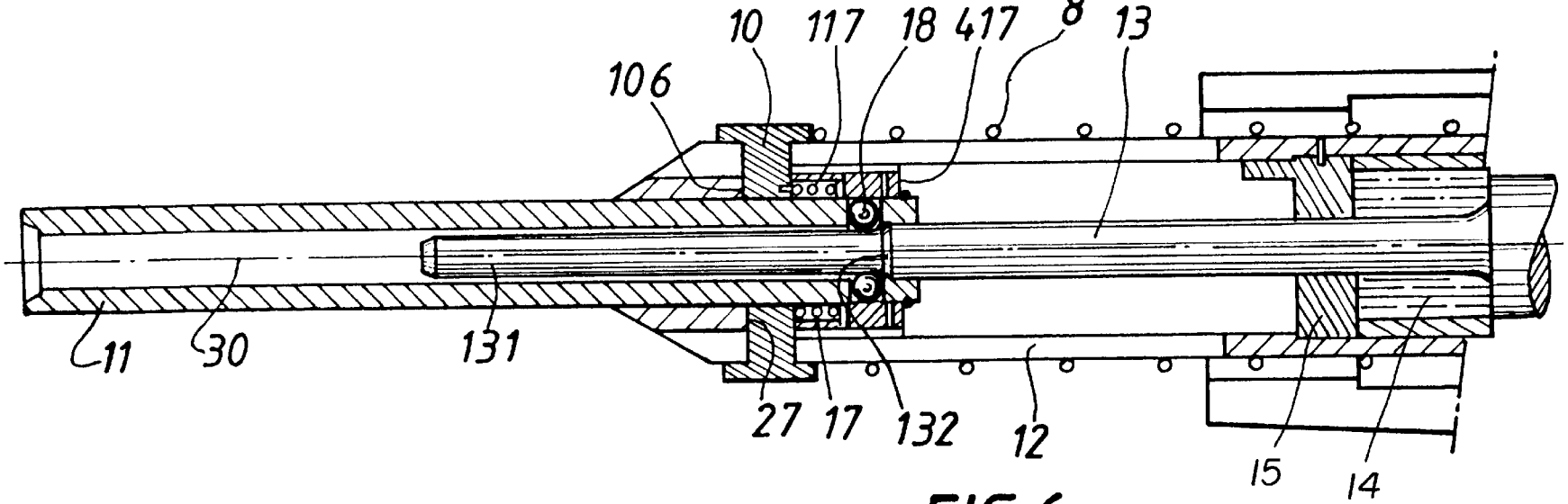
FIG. 6 is a view in partial axial section of a third embodiment of the apparatus in the open position.
Figure 7:
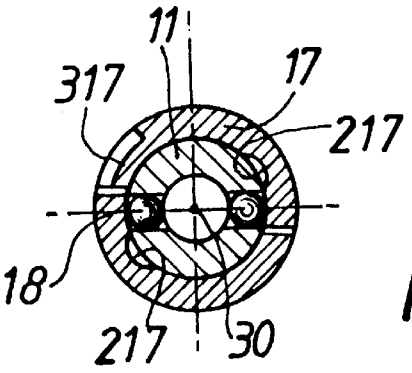
FIG. 7 is a view in section of the braking ring and plug guide of the apparatus of FIG. 6.

In the embodiment of FIGS. 6 and 7 in which similar components are designated with the same references, the plunger 13 has a rod portion 131 with a narrower cross-section, the braking ring 17 is rotatably mounted on the plug guide 11 and in the return position under the action of a torsion spring 117 fixed to the braking ring 17 and to the guide ring 10, the braking ring 17 has two inner recesses 217, for partly receiving the braking balls 18 allowing them to be eliminated and moved away from the plunger rod 131, and the braking ring 17 has an outer cam surface 317 designed to cooperate with a finger, fixed in rotation, of the barrel 6, in order to turn it against the action of the torsion spring 117. This cam surface 317 is in this particular case a peripheral ramp inclined, from the rear transverse edge 417 of the ring 17, both to the axis 30 of the apparatus and to a plane perpendicular to this axis 30, such as that of FIG. 7 for example, the finger of the barrel 6 projecting axially forwards.

After firing, when the apparatus of FIGS. 6, 7 is moved away from the supporting surface 2, the spring 8 drives the guide ring 10 and the plug guide 11 forwardly until the front edge 106 of the ring 10 abuts against the front end 27 of the groove 12, without either the braking ring 17 or the plunger 13 having been displaced relative to the plug guide 11.

When the braking balls 18 arrive in the region of the narrower rod portion 131 of the plunger, they are displaced towards the axis 30 and release the braking ring 17 which, under the action of the torsion spring 117, returns to the rest position.

After introduction of a new plug into the plug guide 11, when the apparatus is again applied against surface, the balls 18 cooperate with the annular shoulder 132 formed on the plunger 13 by its narrower portion 131, to return the plunger 13 rearwardly, in the manner of a return pawl.

At the end of the return stroke, the plunger 13 is released by rotation of the braking ring 17 by the finger of the barrel 6 and removal of the balls 18 and reception of the same in the recesses 217 of the ring 17.

We claim:

1. Apparatus for driving plug fasteners, comprising:

a barrel;

a plug guide, for housing a plug fastener to be driven into a substrate, movably mounted with respect to said barrel between a first forwardly extended inoperative position and a second rearwardly retracted operative position;

a plunger, having a first driven head end thereof disposed within said barrel, and a second driving rod end disposed within said plug guide, for movement between a first rearwardly retracted non-firing position, and a second forwardly extended fired position at which said plunger rod end drives a plug fastener, disposed within said plug guide, into a substrate;

means operatively associated with said barrel for causing said plunger to be driven from said first rearwardly retracted non-firing position to said second forwardly extended fired position; and one-way braking means movably mounted upon said plug guide between a first position at which said braking means is disengaged from said plunger so as to permit said plunger to move substantially freely from said first rearwardly retracted non-firing position to said second forwardly extended fired position so as to drive a plug fastener, disposed within said plug guide, into a substrate, and a second position at which said braking means is lockingly engaged with said plunger so as to return said plunger from said second forwardly extended fired position to said first rearwardly retracted non-firing position when said plug guide is moved from said first forwardly extended inoperative position to said second rearwardly retracted operative position.

2. The apparatus as set forth in claim 1, wherein said one-way braking means comprises:

a set of radially movable braking balls mounted upon said plug guide; and a braking ring movably mounted upon said plug guide and having a first section having a first interior diameter dimension which permits said radially movable braking balls to move radially outwardly away from said plunger, when said braking ring is disposed at a first position with respect to said plug guide, and thereby permit said braking balls to be disengaged from said plunger rod, and a second section having a second interior diameter dimension which is less than said first interior diameter dimension and which causes said radially movable braking balls to move radially inwardly toward said plunger rod, when said braking ring is disposed at a second position with respect to said plug guide, and thereby be engaged with said plunger rod.

3. The apparatus as set forth in claim 2, further comprising:

a retaining ring mounted upon said plug guide for maintaining said braking ring mounted upon said plug guide.

4. The apparatus as set forth in claim 2, further comprising:

a guide ring fixedly mounted upon said plug guide and spring means interposed between said barrel and said guide ring for normally biasing said guide ring and and plug guide toward said first forwardly extended inoperative position.

5. The apparatus as set forth in claim 4, further comprising:

groove means defined within said barrel for guiding the movement of said guide ring with respect to said barrel under the biasing influence of said spring means; and said barrel has an end wall defining a forward terminating end of said groove means so as to encounter said braking ring, when said guide ring and said plug guide are moved toward said first forwardly extended inoperative position by said spring means, and thereby cause said braking ring to be moved relative to said plug guide such that said second section of said braking ring, having said second interior diameter dimension, engages said braking balls and causes said braking balls to be moved radially inwardly into engagement with said plunger rod.

6. The apparatus as set forth in claim 5, wherein:

said braking means rigidly interconnects said plug guide and said plunger rod when said braking means is engaged with said plunger.

7. The apparatus as set forth in claim 6, wherein:

said braking means rigidly interconnects said plug guide and said plunger rod prior to completion of said movement of said plug guide from said second rearwardly retracted operative position to said first forwardly extended inoperative position.

8. The apparatus as set forth in claim 6, further comprising:

ring means disposed within said barrel for encountering said braking ring, when said guide ring and said plug guide are moved from said first forwardly extended inoperative position toward said second rearwardly retracted operative position and when said braking means rigidly interconnects said plug guide and said plunger rod, so as to cause said braking ring to be moved relative to said plug guide such that said first section of said braking ring, having said first interior diameter dimension, permits said braking balls to move radially outwardly and be disengaged from said plunger rod.

9. The apparatus as set forth in claim 4, further comprising:

threaded engagement means defined between said guide ring and said plug guide for threadedly mounting said guide ring upon said plug guide.

10. The apparatus as set forth in claim 4, wherein:

said braking balls are disposed within said first section of said braking ring after said plunger has been moved to said second forwardly extended fired position so as to drivingly move said braking ring along with said plug guide and said guide ring when said spring means biases said guide ring and said plug guide toward said first forwardly extended inoperative position.

11. The apparatus as set forth in claim 4, wherein:

said guide ring and said plug guide comprise a single piece component.

12. The apparatus as set forth in claim 1, wherein:

said plug guide has a predetermined inner diametrical extent; and said plunger rod has an external diametrical extent which is substantially the same as said predetermined inner diametrical extent of said plug guide.

13. The apparatus as set forth in claim 12, wherein:

the diametrical extent of said said plunger rod is substantially constant throughout the longitudinal extent of said plunger rod.

14. The apparatus as set forth in claim 1, wherein:

said plug guide has a predetermined inner diametrical extent; and said plunger rod has a first section thereof, disposed within said plug guide, which has an external diametrical extent which is substantially less than said predetermined inner diametrical extent of said plug guide.

15. The apparatus as set forth in claim 14, wherein:

said plunger rod has a second section, interposed between said first section and said driven head end, which has an external diametrical extent which is greater than said external diametrical extent of said first section of said plunger rod.

16. The apparatus as set forth in claim 15, wherein:

a transition section smoothly interconnects said first and second sections of said plunger rod.

17. The apparatus as set forth in claim 14, wherein said one-way braking means comprises:

a set of radially movable braking balls mounted upon said plug guide; and a braking ring movably mounted upon said plug guide so as to permit said radially movable braking balls to move radially outwardly away from said first section of said plunger rod when said braking ring is disposed at a first position with respect to said plug guide and thereby permit said braking balls to be disengaged from said first section of said plunger rod, and for biasing said braking balls into engagement with said first section of said plunger rod as a result of radially inward movement of said braking balls when said braking ring is disposed at a second position with respect to said plug guide.

18. The apparatus as set forth in claim 1, wherein said one-way braking means comprises:

a set of radially movable braking balls mounted upon said plug guide; and a braking ring having a set of recesses defined therein and movably mounted upon said plug guide so as to permit said radially movable braking balls to move radially outwardly away from said plunger rod when said braking ring is disposed at a first position with respect to said plug guide and thereby permit said braking balls to be disengaged from said plunger rod, and to cause said radially movable braking balls to move radially inwardly toward said plunger rod when said braking ring is disposed at a second position with respect to said plug guide whereby said braking balls are engaged with said plunger rod.

19. The apparatus as set forth in claim 18, wherein:

said braking ring is rotatably mounted upon said plug guide between said first and second positions at which said braking balls are disposed within said recesses of said braking ring, and out of said recesses of said braking ring, respectively; and a torsion spring interconnects said braking ring to a guides ring fixedly mounted upon said plug guide.

20. The apparatus as set forth in claim 18, wherein:

said plunger rod has first and second sections having relatively small and large diametrical extents, and a transition section interconnecting said first and second sections; and said braking balls engage said transition section of said plunger rod so as to move said plunger from said second forwardly extended fired position to said first rearwardly retracted non-firing position when said plug guide is moved from said first forwardly extended inoperative position to said second rearwardly retracted operative position.

* * * * *